US008746126B2

(12) United States Patent
Zheng

(10) Patent No.: US 8,746,126 B2
(45) Date of Patent: Jun. 10, 2014

(54) ANNULAR PISTON SYSTEM FOR RIFLES

(71) Applicant: Jing Zheng, Hamburg (DE)

(72) Inventor: Jing Zheng, Hamburg (DE)

( * ) Notice: Subject to any disclaimer, the term of this patent is extended or adjusted under 35 U.S.C. 154(b) by 0 days.

(21) Appl. No.: 13/658,712

(22) Filed: Oct. 23, 2012

(65) Prior Publication Data

US 2013/0291713 A1 Nov. 7, 2013

Related U.S. Application Data

(60) Provisional application No. 61/563,278, filed on Nov. 23, 2011.

(51) Int. Cl.
*F41A 5/20* (2006.01)

(52) U.S. Cl.
USPC ..... 89/191.02

(58) Field of Classification Search
USPC ..... 89/191.01, 191.02, 192, 193, 14.05, 16; 42/76.01, 77
See application file for complete search history.

(56) References Cited

U.S. PATENT DOCUMENTS 855,439 A * 6/1907 Adrianson ..... 42/59
2,466,578 A * 4/1949 Corte ..... 89/33.16
2,628,536 A * 2/1953 Schiach ..... 89/159
3,261,264 A * 7/1966 Wilson ..... 89/193
3,284,942 A * 11/1966 Moseley ..... 42/79
3,736,839 A * 6/1973 Childers ..... 89/128
4,019,423 A * 4/1977 Johnson ..... 89/178
4,020,740 A * 5/1977 Schirneker ..... 89/129.02
4,635,530 A * 1/1987 Weldle ..... 89/159
4,930,399 A * 6/1990 Trevor, Jr. ..... 89/191.02
4,977,815 A * 12/1990 Stephens ..... 89/180
5,123,329 A * 6/1992 Irwin ..... 89/161
5,325,617 A * 7/1994 Vojta et al. ..... 42/75.03
8,025,003 B1 * 9/2011 Saur ..... 89/14.05
2005/0115398 A1 * 6/2005 Olson ..... 89/193
2006/0065112 A1 * 3/2006 Kuczynko et al. ..... 89/193
2007/0089598 A1 * 4/2007 Courty ..... 89/196
2011/0271826 A1 * 11/2011 Molinari ..... 89/193
2012/0137871 A1 * 6/2012 O'Brien ..... 89/191.02

* cited by examiner

*Primary Examiner* — Bret Hayes
(74) *Attorney, Agent, or Firm* — Han IP Corporation; Andy M. Han

(57) ABSTRACT

An annular piston system for a firearm comprises a barrel, a gas block assembly, a piston, and a spring. The barrel has multiple sections lengthwise, one of the sections having at least one gas port hole to vent gas from the barrel. The gas block assembly is disposed annularly around the barrel and is adjustable to control an amount of gas flowing out of the barrel through the at least one gas port hole. The piston is disposed annularly around the barrel and can move longitudinally along the barrel in response to being pushed by the gas flowing out of the barrel. The spring is disposed annularly around the third section of the barrel and coupled to the piston. The spring limits a distance that the piston can move longitudinally along the barrel when the piston is pushed to move by the gas flowing out of the barrel.

24 Claims, 15 Drawing Sheets

ANNULAR PISTON SYSTEM FOR RIFLES

CROSS REFERENCE TO RELATED PATENT APPLICATION

The present application claims the priority benefit to U.S. Provisional Patent Application No. 61/563,278, filed on Nov. 23, 2011, which is hereby incorporated by reference in its entirety.

BACKGROUND

1. Technical Field

The present disclosure generally relates to firearms. More specifically, the present disclosure relates to an annular piston system for rifles.

2. Description of Related Art

In the context of firearms, gas-operation is a system of operation that provides energy for auto-loading firearms. In gas-operation, a portion of high pressure gas from the cartridge being fired is used to power a mechanism to extract the spent casing and chamber a new cartridge. Energy from the gas is harnessed through either a port in the barrel or trap at the muzzle. This high-pressure gas impinges on a surface such as a piston head to provide motion for unlocking of the action, extraction and ejection of the spent casing, cocking of the hammer or striker, chambering of a fresh cartridge, and locking of the action.

Most current gas-operation systems employ some type of piston. The face of the piston is acted upon by gas from the combustion of the propellant from the barrel of the firearm. Traditional piston-based gas-operation system is a cylindrical piston that reciprocates on top of, by the side, or under the firearm barrel. Gas is introduced by a gas block that directs the gas to where the piston is located. These designs are generally simple and reliable. However, since the piston is off the center of the barrel, the piston-based gas-operation system tends to introduce a bending moment to the rifle upon firing, undesirably impairing the firearm's accuracy. On the other hand, direct gas impingement system largely keeps the moving parts co-centered with the rifle barrel, hence has better accuracy. However, such system tends to introduce hot gas directly into the firearm receiver. This thus undesirably subjects the firearm receiver under thermal stress and leaves fire powder foul inside the receiver, rendering the firearm more prone to jamming.

There are some historical firearms that have annular piston design. One is the World War II era Walther Mkb42(w) from Germany. This design uses an annular piston and a half circle sleeve to transfer momentum to the bolt carrier. This will lower the bending momentum to the barrel although not eliminating it completely. Due to the complication of manufacturing of this design, the MKb42(w) was less successful than the Haenel MKb42(h), a similar firearm but using a cylindrical piston system that resides on the top of the barrel. The Haenel MKb42(h) was later improved to be the legendary Stg44, the first so called "assault rifle." Another example is the VZ52 from the former Czechoslovakia. It uses an annular piston and a half circle sleeve to transfer the momentum to the bolt carrier, just like the Walther MKb42(w). However, the sleeve and the bolt carrier are not locked to each other. This is what is called a "short stroke" piston system. Both of the aforementioned rifles have their main spring located in the rifle receiver or stock. As such it is very hard to make the total length of the rifle short.

SUMMARY

The present disclosure is directed to an annular piston system that is designed to keep the reliability of a piston system while achieving much better accuracy of the firearm than those using a traditional piston system.

According to one implementation of the present disclosure for machine gun configuration, an annular piston system for a firearm may comprise a barrel, a gas block assembly, a piston, and a spring. The barrel may have a plurality of sections lengthwise. A first section of the barrel may have a first outer diameter. A second section of the barrel is adjacent the first section and may have a second outer diameter. A third section of the barrel is adjacent the second section and may have a third outer diameter. A distal end of the first section may be a first distal end of the barrel, and a distal end of the third section may be a second distal end of the barrel that is opposite the first distal end of the barrel. The second section may have at least one gas port hole traversing through a wall thickness thereof. The gas block assembly may be disposed annularly around the first and second sections of the barrel, and may be adjusted by an operator to control an amount of gas flowing out of the barrel through the at least one gas port hole. The piston may be disposed annularly around the third section of the barrel, and may move longitudinally along the barrel in response to being pushed by the gas flowing out of the barrel. The spring may be disposed annularly around the third section of the barrel and coupled to the piston. The spring may limit a distance that the piston moves longitudinally along the barrel when the piston is pushed to move towards the second distal end of the barrel by the gas flowing out of the barrel.

In some embodiments, the third outer diameter may be greater than the second outer diameter, and the second outer diameter may be greater than the first outer diameter.

In some embodiments, the first distal end of the barrel may include a threaded portion and the second distal end of the barrel may include a threaded portion. In some embodiments, the annular piston system may further comprise a muzzle device and a barrel extension. The muzzle device may mate with the threaded portion on the first distal end of the barrel. The barrel extension may mate with the threaded portion on the second distal end of the barrel. In some embodiments, the annular piston system may further comprise two or more piston rods, a piston locking ring, and a barrel locking device. The piston rods may be coupled to the piston and disposed between the spring and the barrel. The piston locking ring may be disposed annularly around the barrel and the piston rods and coupled to the piston. The barrel locking device may be disposed annularly around the barrel extension. A first end of the spring may be coupled to the piston locking ring and a second end of the spring opposite the first end may be coupled to the barrel locking device. In some embodiments, the spring may provide centrifugal limit for the two or more piston rods.

In some embodiments, the two or more piston rods may be evenly distributed around the barrel. At least one of the piston rods may include a relief cut defined thereon to clear magazine or belt feed ammunition.

In some embodiments, the annular piston system may further comprise a heat shield that is disposed annularly around the barrel and that shrouds the gas block assembly, the piston, and the spring. At least a portion of a length of the heat shield may include a plurality of ventilation holes.

In some embodiments, the gas block assembly may comprise a gas block, a gas block locking ring, and a ring actuator. The gas block may be disposed annularly around the first section of the barrel and may be movable circumferentially with respect to the barrel. The gas block locking ring may be disposed annularly around the first section of the barrel and between the barrel and the gas block, and may be coupled to the gas block. The ring actuator may be disposed annularly around the first section of the barrel and between the barrel and the gas block. The ring actuator may be coupled to the gas block locking ring and movable circumferentially with respect to the barrel to push/pull the gas block locking ring between a first position and a second position. The gas block may be locked with respect to the barrel when the gas block locking ring is in the first position. The gas block may be unlocked with respect to the barrel when the gas block locking ring is in the second position.

In some embodiments, a portion of an outer surface of the first section of the barrel may include a plurality of serrated protrusions that hold the gas block in place longitudinally with respect to the barrel.

In some embodiments, the gas block assembly may further comprise a gas regular that is disposed annularly around the second section of the barrel. The gas regulator may have a first hole and a second hole traversing through a wall thickness thereof. The first hole may have a size approximately equal to that of the at least one gas port hole. The second hole may have a size smaller than that of the at least one gas port hole. The gas regulator may be moved by an operator circumferentially with respect to the barrel between a first position to align the first hole with the at least one gas port hole to vent more gas from the barrel and a second position to align the second hole with the at least one gas port hole to vent less gas from the barrel.

According to another implementation of the present disclosure for regular rifle configuration, an annular piston system for a firearm may comprise a barrel, a gas block assembly, a piston, and a spring. The barrel may have a plurality of sections lengthwise. A first section of the barrel may have a first outer diameter. A second section of the barrel is adjacent the first section and may have a second outer diameter. A third section of the barrel is adjacent the second section and may have a third outer diameter. A distal end of the first section may be a first distal end of the barrel, and a distal end of the third section may be a second distal end of the barrel that is opposite the first distal end of the barrel. The second section may have at least one gas port hole traversing through a wall thickness thereof. The gas block assembly may be disposed annularly around the first and second sections of the barrel, and may be adjusted by an operator to control an amount of gas flowing out of the barrel through the at least one gas port hole. The piston may be disposed annularly around the third section of the barrel, and may move longitudinally along the barrel in response to being pushed by the gas flowing out of the barrel. The spring may be disposed annularly around the third section of the barrel and coupled to the piston. The spring may limit a distance that the piston moves longitudinally along the barrel when the piston is pushed to move towards the second distal end of the barrel by the gas flowing out of the barrel.

In some embodiments, the third outer diameter may be greater than the second outer diameter, and the second outer diameter may be greater than the first outer diameter.

In some embodiments, an outer surface of the third section of the barrel may have at least one straight flute thereon. Alternatively, the outer surface of the third section of the barrel may have at least one helical flute thereon.

In some embodiments, the first distal end of the barrel may include a threaded portion and the second distal end of the barrel may include a threaded portion. In some embodiments, the annular piston system may further comprise a muzzle device and a barrel extension. The muzzle device may mate with the threaded portion on the first distal end of the barrel. The barrel extension may mate with the threaded portion on the second distal end of the barrel. In some embodiments, the annular piston system may further comprise two or more piston rods, a piston locking ring, and a barrel locking device. The piston rods may be coupled to the piston and disposed between the spring and the barrel. The piston locking ring may be disposed annularly around the barrel and the piston rods and coupled to the piston. The barrel locking device may be disposed annularly around the barrel extension. A first end of the spring may be coupled to the piston locking ring and a second end of the spring opposite the first end may be coupled to the barrel locking device.

In some embodiments, the spring may provide centrifugal limit for the two or more piston rods.

In some embodiments, the two or more piston rods may be evenly distributed around the barrel. At least one of the piston rods may include a relief cut defined thereon to clear magazine or belt feed ammunition.

In some embodiments, a portion of an outer surface of the first section of the barrel may include a plurality of serrated protrusions. The gas block assembly may comprise a gas block, a gas block locking ring, and a locking spring. The gas block may be disposed annularly around the first section of the barrel and movable circumferentially with respect to the barrel. The gas block may have a plurality of inner diameter protrusions on an inner diameter thereof, and may be held in place with respect to the barrel when the inner diameter protrusions are engaged with the serrated protrusions of the first section of the barrel. The gas block locking ring may be disposed annularly around the first section of the barrel and between the barrel and the gas block. The gas block locking ring may be coupled to the gas block. The locking spring may be disposed annularly around the first section of the barrel and between the barrel and the gas block. The locking spring may be compressibly coupled between the gas block locking ring and the second section of the barrel such that the gas block is rotatable circumferentially with respect to the barrel when the inner diameter protrusions of the gas block are disengaged from the serrated protrusions of the first section of the barrel by the gas block being moved longitudinally towards the second distal end of the barrel with the locking spring compressed.

In some embodiments, the gas block may have a first hole and a second hole traversing through a wall thickness thereof. The first hole may have a size approximately equal to that of the at least one gas port hole. The second hole may have a size smaller than that of the at least one gas port hole. The gas block may be rotatable circumferentially with respect to the barrel between a first position to align the first hole with the at least one gas port hole to vent more gas from the barrel and a second position to align the second hole with the at least one gas port hole to vent less gas from the barrel.

According to a further implementation of the present disclosure for lightweight rifle configuration, an annular piston system for a firearm may comprise a barrel, a gas block, a piston, and a spring. The barrel may have a plurality of sections lengthwise. A first section of the barrel may have a first outer diameter. A second section of the barrel is adjacent the first section and may have a second outer diameter. A third section of the barrel is adjacent the second section and may have a third outer diameter. A fourth section of the barrel is adjacent the third section and may have a fourth outer diameter. A distal end of the first section may be a first distal end of the barrel. A distal end of the fourth section may be a second distal end of the barrel that is opposite the first distal end of the barrel. The second section may have at least one gas port hole traversing through a wall thickness thereof. The gas block may be disposed annularly around the first and second sections of the barrel. The gas block may be adjusted by an operator to control an amount of gas flowing out of the barrel through the at least one gas port hole. The piston may be disposed annularly around the third section of the barrel, and can move longitudinally along the barrel in response to being pushed by the gas flowing out of the barrel. The spring may be disposed annularly around the third and fourth sections of the barrel and coupled to the piston. The spring may limit a distance that the piston moves longitudinally along the barrel when the piston is pushed to move towards the second distal end of the barrel by the gas flowing out of the barrel.

In some embodiments, the fourth outer diameter may be greater than the third outer diameter. The third outer diameter may be greater than the second outer diameter. The second outer diameter may be greater than the first outer diameter.

In some embodiments, an outer surface of the third section of the barrel may have at least one straight flute thereon. Alternatively, the outer surface of the third section of the barrel may have at least one helical flute thereon.

In some embodiments, a first distal end of the gas block toward the first distal end of the barrel may be configured to function as a muzzle. The second distal end of the barrel may include a threaded portion. In some embodiments, the annular piston system may further comprise a barrel extension that mates with the threaded portion on the second distal end of the barrel. Additionally, the annular piston system may also comprise two or more piston rods, a piston locking ring, and a barrel locking device. The piston rods may be coupled to the piston and disposed between the spring and the barrel. The piston locking ring may be disposed annularly around the barrel and the piston rods and coupled to the piston. The barrel locking device may be disposed annularly around the barrel extension. A first end of the spring may be coupled to the piston locking ring. A second end of the spring opposite the first end may be coupled to the barrel locking device.

In some embodiments, the spring may provide centrifugal limit for the two or more piston rods.

In some embodiments, the two or more piston rods may be evenly distributed around the barrel. At least one of the piston rods may include a relief cut defined thereon to clear magazine or belt feed ammunition.

In some embodiments, a portion of an outer surface of the first section of the barrel may include a plurality of serrated protrusions. An inner diameter of the gas block may include a plurality of inner diameter protrusions such that the gas block is held in place with respect to the barrel when the inner diameter protrusions are engaged with the serrated protrusions of the first section of the barrel. In some embodiments, the annular piston system may further comprise a gas block locking ring and a locking spring. The gas block locking ring may be disposed annularly around the first section of the barrel and between the barrel and the gas block, and may be coupled to the gas block. The locking spring may be disposed annularly around the first section of the barrel and between the barrel and the gas block. The locking spring may be compressibly coupled between the gas block locking ring and the second section of the barrel such that the gas block is rotatable circumferentially with respect to the barrel when the inner diameter protrusions of the gas block are disengaged from the serrated protrusions of the first section of the barrel by the gas block being moved longitudinally towards the second distal end of the barrel with the locking spring compressed. In some embodiments, the gas block may have a first hole and a second hole traversing through a wall thickness thereof. The first hole may have a size approximately equal to that of the at least one gas port hole. The second hole may have a size smaller than that of the at least one gas port hole. The gas block may be rotatable circumferentially with respect to the barrel between a first position to align the first hole with the at least one gas port hole to vent more gas from the barrel and a second position to align the second hole with the at least one gas port hole to vent less gas from the barrel.

These and other objectives of the present disclosure will be appreciated by those of ordinary skill in the art after reading the following detailed description of the preferred embodiments that are illustrated in the various figures and drawings.

BRIEF DESCRIPTION OF THE DRAWINGS

The accompanying drawings are included to provide a further understanding of the disclosure, and are incorporated in and constitute a part of the present disclosure. The drawings illustrate embodiments of the disclosure and, together with the description, serve to explain the principles of the disclosure. It is appreciable that the drawings are not necessarily in scale as some components may be shown to be out of proportion than the size in actual implementation in order to clearly illustrate the concept of the present disclosure.

DETAILED DESCRIPTION OF THE PREFERRED EMBODIMENTS

Overview

Figure 1:
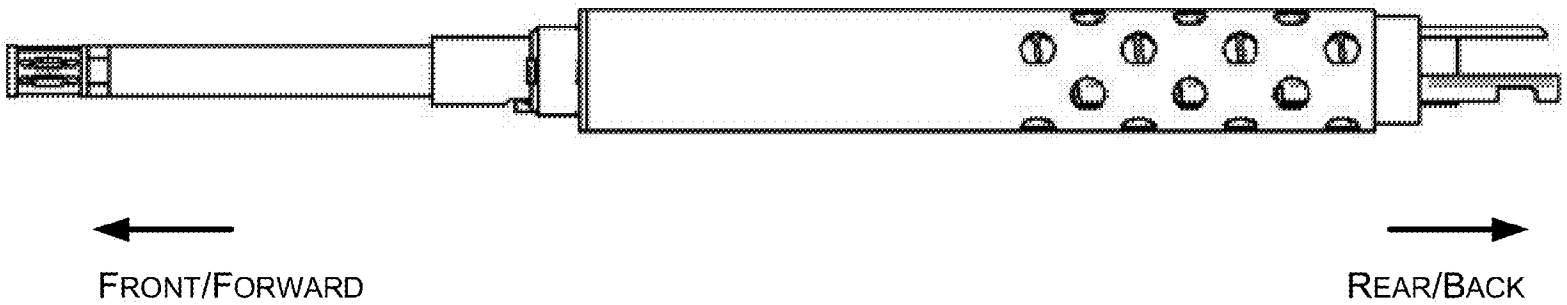
FIG. 1 is a side view of a barrel-piston system assembly for machine gun configuration using an assembled annular piston system in accordance with an embodiment of the present disclosure.

Various embodiments of the present disclosure relate to an annular piston system that is designed to keep the reliability of a piston system while achieving much better accuracy of the firearm than those using a traditional piston system. The embodiments provide an annular long-stroke piston system that wraps around a rifle barrel to provide a reciprocating motion the rifle needs for extracting and ejecting a spent casing and for reloading a fresh cartridge. The inventive design provides several configurations suitable for different firearms. The first configuration, annular piston system 100 illustrated in FIGS. 1-7B, is suitable for machine gun or special rifles that are meant for rapid sustained firing. The second configuration, annular piston system 200 illustrated in FIGS. 8-11B, is suitable for regular rifles. The third configuration, annular piston system 300 illustrated in FIGS. 12-15, is suitable for lightweight rifles.

Reference will now be made in detail to the preferred embodiments of the present disclosure, examples of which are illustrated in the accompanying drawings. Wherever possible, the same reference numbers are used in the drawings and the description to refer to the same or like parts.

The position terms used in the present disclosure, such as "front", "forward", "rear", "back", "top", "bottom", "left", "right", "head", "tail" or the like assume a firearm in the normal firing position, with the firearm being in a position in which the longitudinal axis of the barrel of the firearm runs generally horizontally and the direction of firing points "forward" away from the operator of the firearm. The same convention applies for the direction statements used herein.

Example Embodiments for Machine Guns

According to one implementation of the present disclosure, an annular piston system for a firearm may comprise a barrel, a gas block assembly, a piston, and a spring. The barrel may have a plurality of sections lengthwise. A first section of the barrel may have a first outer diameter. A second section of the barrel is adjacent the first section and may have a second outer diameter. A third section of the barrel is adjacent the second section and may have a third outer diameter. A distal end of the first section may be a first distal end of the barrel, and a distal end of the third section may be a second distal end of the barrel that is opposite the first distal end of the barrel. The second section may have at least one gas port hole traversing through a wall thickness thereof. The gas block assembly may be disposed annularly around the first and second sections of the barrel, and may be adjusted by an operator to control an amount of gas flowing out of the barrel through the at least one gas port hole. The piston may be disposed annularly around the third section of the barrel, and may move longitudinally along the barrel in response to being pushed by the gas flowing out of the barrel. The spring may be disposed annularly around the third section of the barrel and coupled to the piston. The spring may limit a distance that the piston moves longitudinally along the barrel when the piston is pushed to move towards the second distal end of the barrel by the gas flowing out of the barrel.

In some embodiments, the third outer diameter may be greater than the second outer diameter, and the second outer diameter may be greater than the first outer diameter.

In some embodiments, the first distal end of the barrel may include a threaded portion and the second distal end of the barrel may include a threaded portion. In some embodiments, the annular piston system may further comprise a muzzle device and a barrel extension. The muzzle device may mate with the threaded portion on the first distal end of the barrel. The barrel extension may mate with the threaded portion on the second distal end of the barrel. In some embodiments, the annular piston system may further comprise two or more piston rods, a piston locking ring, and a barrel locking device. The piston rods may be coupled to the piston and disposed between the spring and the barrel. The piston locking ring may be disposed annularly around the barrel and the piston rods and coupled to the piston. The barrel locking device may be disposed annularly around the barrel extension. A first end of the spring may be coupled to the piston locking ring and a second end of the spring opposite the first end may be coupled to the barrel locking device.

In some embodiments, the spring may provide centrifugal limit for the two or more piston rods.

In some embodiments, the two or more piston rods may be evenly distributed around the barrel. At least one of the piston rods may include a relief cut defined thereon to clear magazine or belt feed ammunition.

In some embodiments, the annular piston system may further comprise a heat shield that is disposed annularly around the barrel and that shrouds the gas block assembly, the piston, and the spring. At least a portion of a length of the heat shield may include a plurality of ventilation holes.

In some embodiments, the gas block assembly may comprise a gas block, a gas block locking ring, and a ring actuator. The gas block may be disposed annularly around the first section of the barrel and may be movable circumferentially with respect to the barrel. The gas block locking ring may be disposed annularly around the first section of the barrel and between the barrel and the gas block, and may be coupled to the gas block. The ring actuator may be disposed annularly around the first section of the barrel and between the barrel and the gas block. The ring actuator may be coupled to the gas block locking ring and movable circumferentially with respect to the barrel to push/pull the gas block locking ring between a first position and a second position. The gas block may be locked with respect to the barrel when the gas block locking ring is in the first position. The gas block may be unlocked with respect to the barrel when the gas block locking ring is in the second position.

In some embodiments, a portion of an outer surface of the first section of the barrel may include a plurality of serrated protrusions that hold the gas block in place longitudinally with respect to the barrel.

In some embodiments, the gas block assembly may further comprise a gas regular that is disposed annularly around the second section of the barrel. The gas regulator may have a first hole and a second hole traversing through a wall thickness thereof. The first hole may have a size approximately equal to that of the at least one gas port hole. The second hole may have a size smaller than that of the at least one gas port hole. The gas regulator may be moved by an operator circumferentially with respect to the barrel between a first position to align the first hole with the at least one gas port hole to vent more gas from the barrel and a second position to align the second hole with the at least one gas port hole to vent less gas from the barrel.

Figure 2:
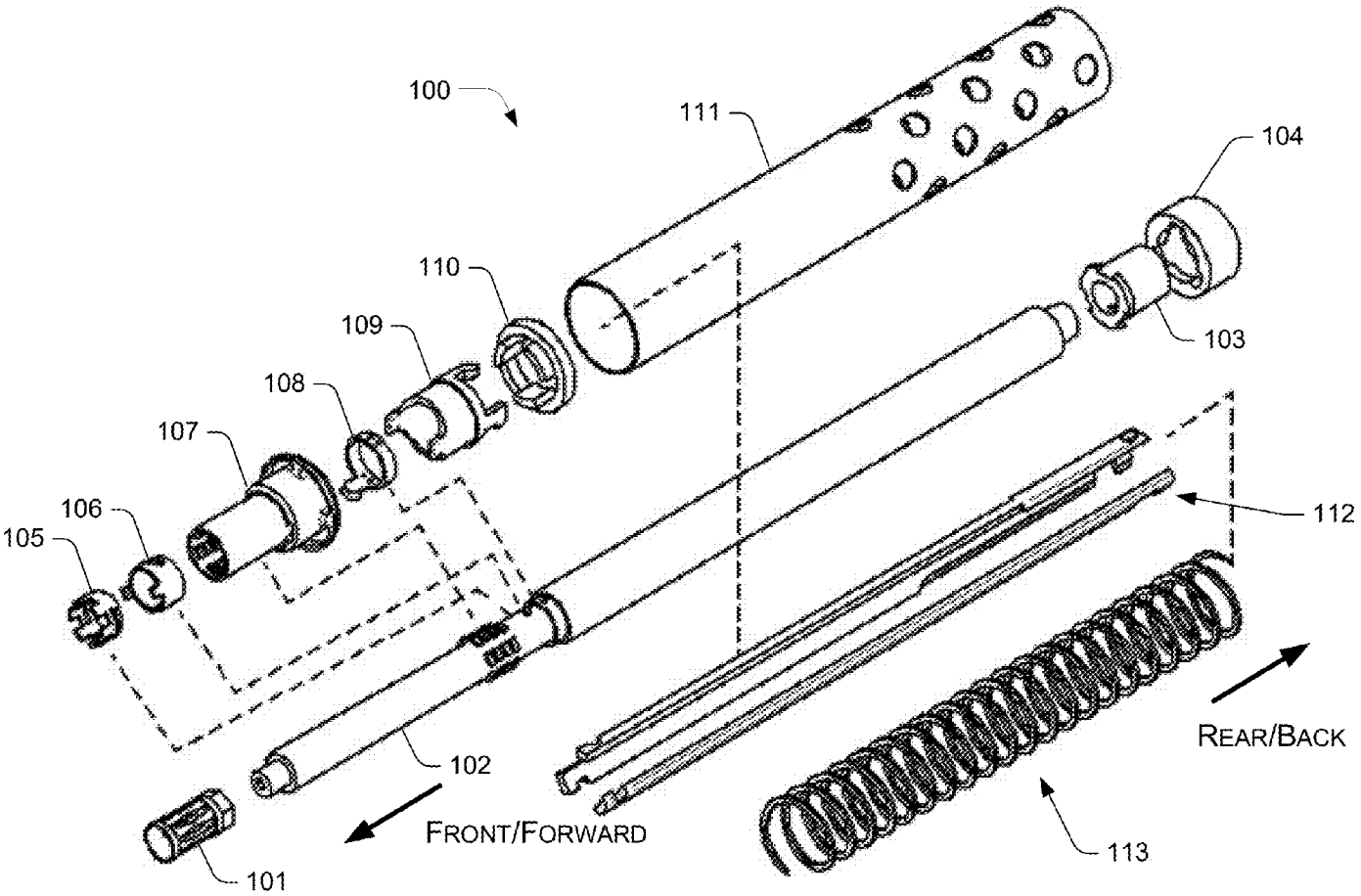
FIG. 2 is an exploded view of the annular piston system of FIG. 1.
Figure 3:
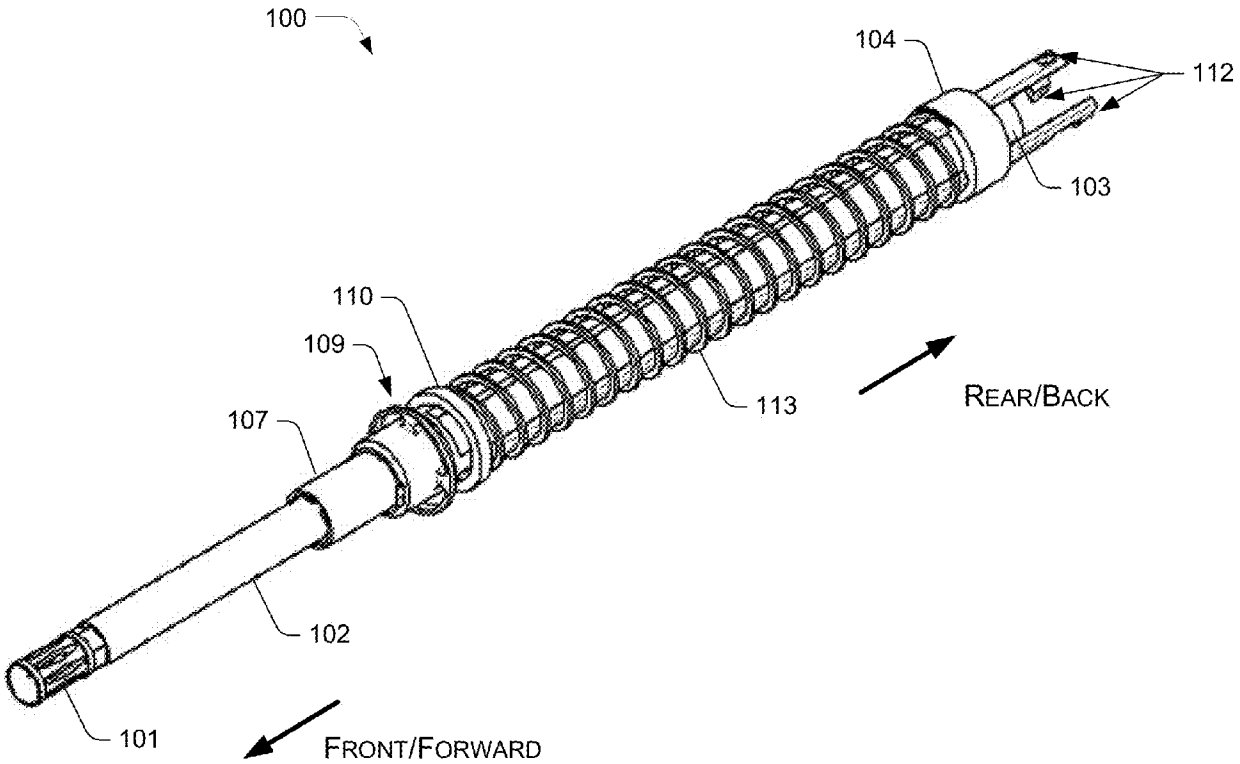
FIG. 3 is an assembly view of the annular piston system of FIG. 2.
Figure 4:
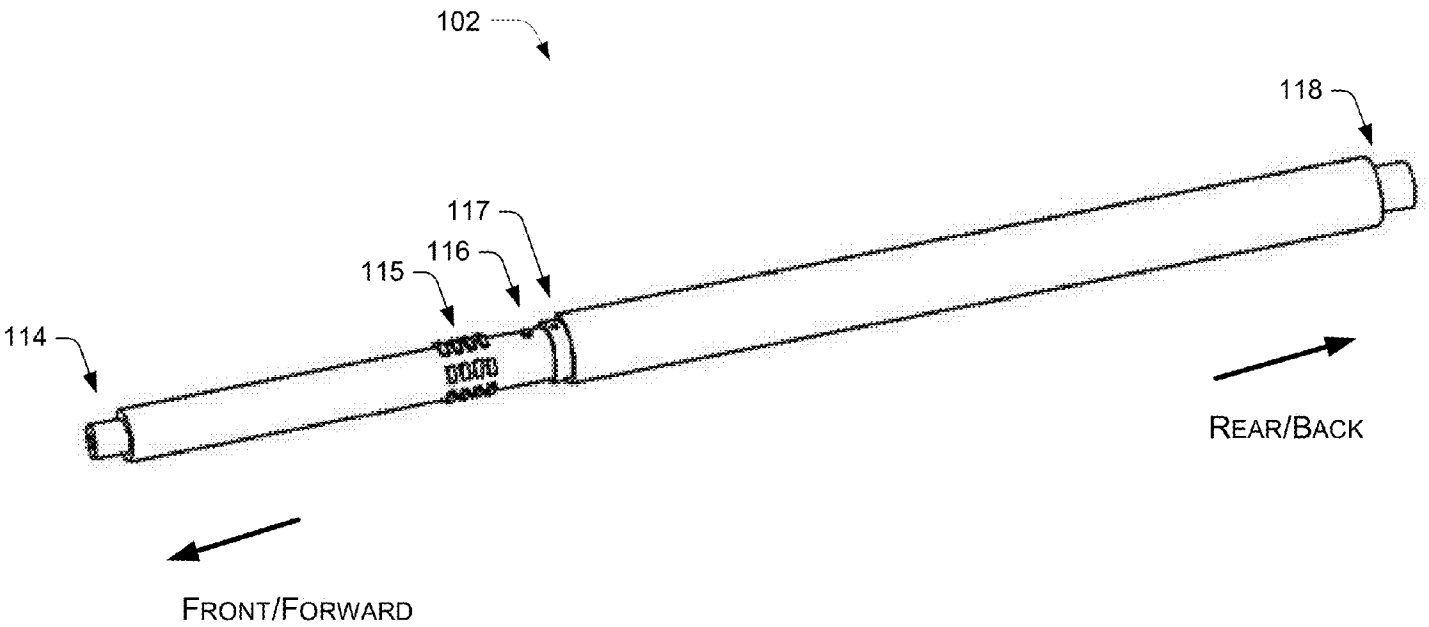
FIG. 4 is a perspective view of a heavy barrel of the annular piston system of FIG. 2.

FIG. 1 illustrates a barrel-piston system assembly for machine gun configuration using an assembled gas-operation annular piston system 100. FIG. 2 illustrates an exploded view of the annular piston system 100. FIG. 3 illustrates an assembly view of the annular piston system 100. FIG. 4 illustrates a heavy barrel 102 of the annular piston system 100.

As shown in FIG. 2, the annular piston system 100 comprises a muzzle device 101, a special profiled rifle barrel 102, a barrel extension 103, a barrel locking device 104, a gas block locking ring 105, a ring actuator 106, a gas block 107, a gas regulator 108, a piston 109, a piston locking ring 110, a heat shield 111, two or more piston rods 112, and a main spring 113.

As shown in FIG. 4, the barrel 102 has a generally step-down profile in a longitudinal direction from the rear end towards the front end. That is, the barrel 102 can be seen as having multiple sections—the section near the rear end having the largest diameter and each successive section toward the front having a smaller diameter with the section at the front end having the smallest diameter. Such feature allows the ease of disassembling the annular piston system 100. On the front half of the barrel 102, step 114 is threaded and is where the muzzle device 101 is received when assembled. The serrated steps 115 are used to hold the gas block 107 in the longitudinal direction. The gas block 107 has matching internal steps to mate with the steps 115 on the barrel 102. A pin 116 is provided on the rear-end side of the steps 115 to be the anchor where the ring actuator 106 resides. After that, the barrel 102 has a raised feature referred to herein as the gas port step 117. At the gas port step 117, one or more gas port holes may be drilled through the wall of the barrel 102 to introduce hot gas into the gas block 107 when assembled. The one or more gas port holes at the gas port step 117 may be drilled either vertically with respect to the wall of the barrel 102 or in an angle with respect to the axis of the barrel 102. It is here where the gas regulator 108 is mounted. After the gas port step 117, the diameter of the barrel 102 remains unchanged until the barrel extension thread step 118. It is at the barrel extension thread step 118 that the barrel extension 103 is mated with the barrel 102. The barrel locking device 104 may be a barrel nut (as shown in FIG. 2) or some quick change barrel locking device commonly used in machine gun barrel design.

Figure 5B:
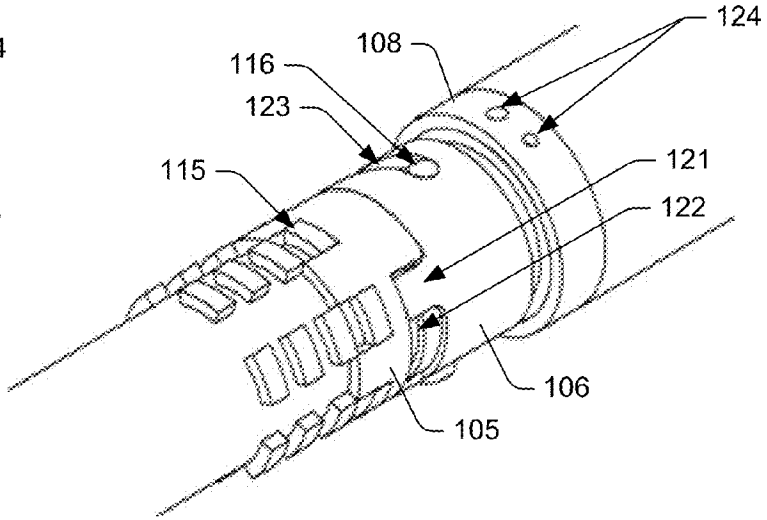
FIG. 5B is the gas block locking mechanism of FIG. 5A in a locked position.
Figure 5A:
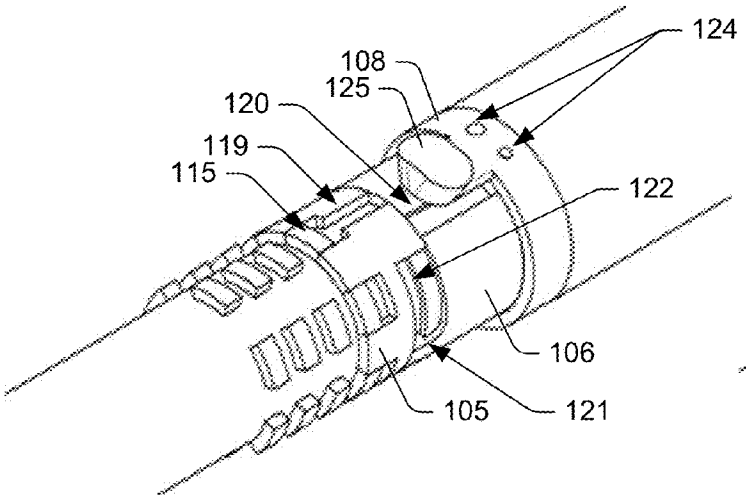
FIG. 5A is a gas block locking mechanism in an unlocked position in accordance with an embodiment of the present disclosure.

FIG. 5A illustrates a gas block locking mechanism in an unlocked position. FIG. 5B illustrates the gas block locking mechanism of FIG. 5A in a locked position.

As shown in FIGS. 5A and 5B, each of the gas block locking ring 105 and the ring actuator 106 has a cut 119 or 120, respectively, on the side of its wall along the longitudinal direction. Both the gas block locking ring 105 and the ring actuator 106 have an inner diameter that is slightly larger than the barrel diameter of barrel 102 where they are mounted, while their outer diameter is slightly smaller than the inner diameter of the gas block 107 where they are located when mounted. To mount the gas block locking ring 105 and the ring actuator 106 to the barrel 102 through the front side of the barrel 102, they need to be sprung open from the cuts 119 and 120 on the wall to clear the bigger-diameter steps 115 on the barrel 102. The ring actuator 106 has one or more teeth 121 that bite into an actuation slot 122 of the gas block locking ring 105. A cam slot 123 on the ring actuator 106 mates with the anchor pin 116 located on the barrel 102. When the ring actuator 106 turns, it will pull or push the gas block locking ring 105 to move back and forth to lock and unlock the gas block 107 with the barrel 102 in the circumferentially tangent direction. The gas block locking ring 105 and the ring actuator 106 secure or lock the gas block 107 to the barrel 102. To assemble, the gas block 107 is pushed into the position with the right index relationship with the step 115. The gas block locking ring 105 will be pushed back with the gas block 107. When the teeth on the gas block 107 are clear of the corresponding steps 115, the gas block 107 can be turned. With the ring actuator 106 in a locking position, the gas block locking ring 105 will lock the gas block 107 once the teeth on the gas block 107 have been turned out of the way. The gas block locking ring 105 and the ring actuator 106 also enhance the ease of assembling and disassembling the piston system 100.

Also shown in FIGS. 5A and 5B, the gas regulator 108 is a ring shaped part that has two gas holes 124 (one big, one small) on each side (top and bottom) of the ring wall and a switch lever 125 in a certain position of the wall. The gas regulator 108 is mounted with its gas holes 124 aligned with the gas port hole on the step 117 of the barrel 102. The bigger hole has approximately the same diameter as that of the one or more gas port holes of the gas port step 117, while the smaller hole is smaller than that of the one or more gas port holes of the gas port step 117. In regular condition, it is the smaller hole of gas holes 124 that aligns with the one or more gas port holes of the gas port step 117. However, in the case the firearm 10 is in an environment that needs more gas to operate reliably, the gas regular 108 can be turned so that the bigger hole of gas holes 124 aligns with the one or more gas port holes of the gas port step 117, hence more gas will go to the annular piston system 100 to help reliable operation.

Figure 6B:
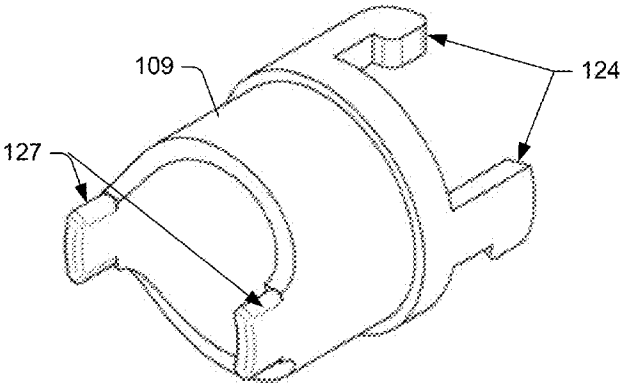
FIG. 6B is a perspective view of a piston in accordance with an embodiment of the present disclosure.
Figure 6A:
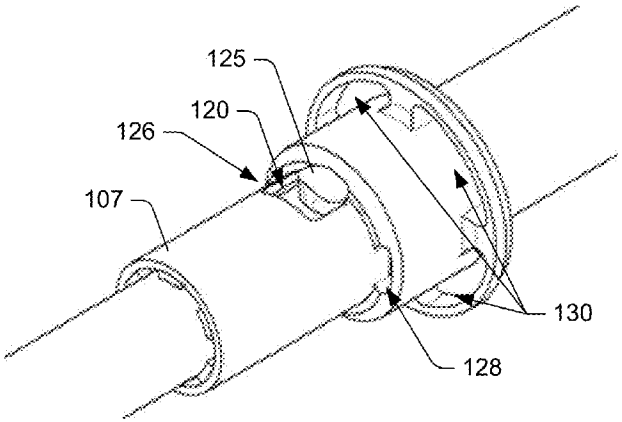
FIG. 6A is an assembly view of a gas block in accordance with an embodiment of the present disclosure.
Figure 7A:
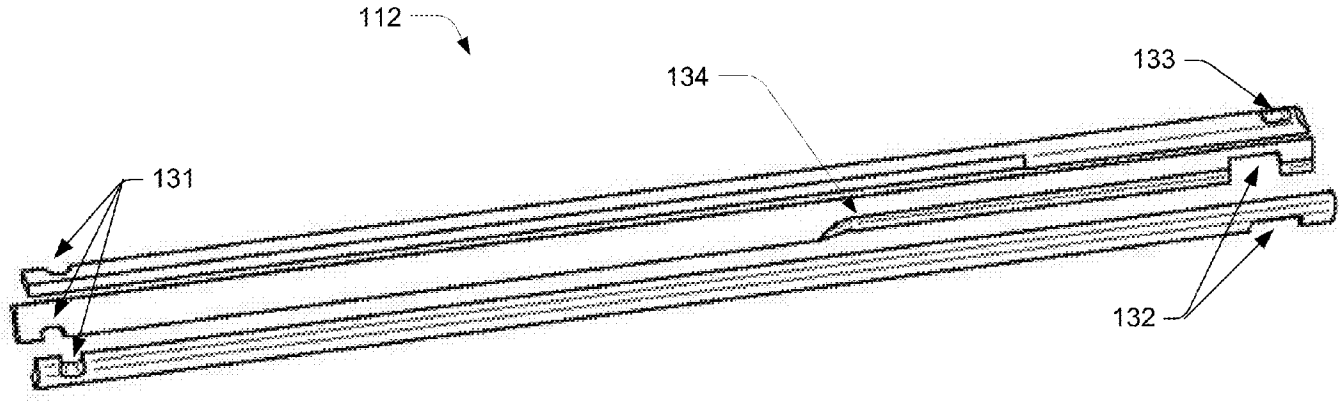
FIG. 7A is a piston rod in accordance with an embodiment of the present disclosure.
Figure 7B:
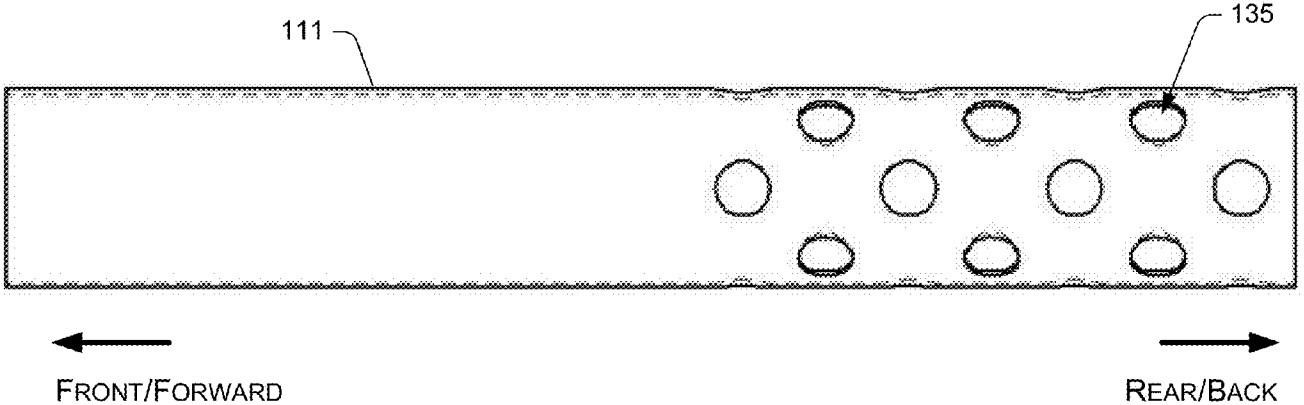
FIG. 7B is a heat shield in accordance with an embodiment of the present disclosure.

FIG. 6A illustrates the gas block assembly. FIG. 6B illustrates the piston 109. FIG. 7A illustrates a plurality of piston rods 112. FIG. 7B illustrates the heat shield 111.

As shown in FIG. 6A, the switch lever 125 on the gas regulator 108 is pointing downward, through an access hole 126 on the gas block 107. Through the access hole 126, two actuation actions can be performed for two distinct functions. One of the functions is that the operator of this system can push/pull the gas block locking ring 105 to lock/unlock the gas block 107 through the wall cut 120 of the ring actuator 106. This actuation can be done with the bullet head of a fresh cartridge; hence no dedicated tool is needed. The ring actuator 106 has a cut 120 on its wall that leaves a gap into which a bullet head can be inserted. The gap is designed to be positioned right at the access hole 126 of the gas block 107 to ensure that it is constantly accessible, whether in open or closed position. The other function is that, at the access hole 126, the operator can turn the switch lever 125 of the gas regulator 108 to adjust the amount of the gas flowing into the gas block 107. The gas block 107 has multiple venting holes 130 outside of a gas chamber of the gas block 107. These venting holes 130 are designed to vent the heated air around the barrel 102 out of the heat shield 111 as pushed by the reciprocating motion of the piston 109 and piston locking ring 110.

Figure 6C:
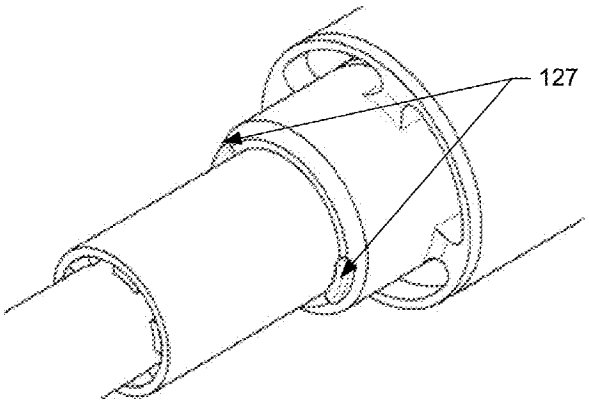
FIG. 6C is an assembly view of the gas block of FIG. 6A in one configuration in accordance with an embodiment of the present disclosure.

As shown in FIGS. 6A-6C, the piston 109 has one or multiple (two are shown) prongs 127 on its head, corresponding to the one or more gas port holes on the gas port step 117 drilled on the barrel 102. The prongs 127 will be inserted into the gas vent holes 128 (as shown in FIG. 6C) on the gas block 107 to seal the gas chamber, when the rifle's bolt carrier is in a locked position. The gas chamber is the space formed between the gas block 107 and the barrel 102 and has a generally annular shape to accommodate the piston 109. When a fresh cartridge is fired, a bullet will travel through the barrel 102. When the bullet travels past the gas port step 117, part of the hot gas will enter the chamber of the gas block 107 through the one or more gas port holes on the gas port step 117 and push the piston 109 backward. When the piston 109 reaches certain speed, it is desirable to vent the hot gas out of the chamber of the gas block 107 so that the piston 109 will not accelerate further. This is when the prongs 127 of the piston 109 clears the gas vent holes 128 of the gas block 107. On the back of the piston 109, there are multiple hooks 129 that are used to connect with the two or more piston rods 112. The number of the hooks 129 is determined by how many piston rods 112 there are in the actual rifle design. Regardless of the number, the piston rods 112 may be evenly distributed around the barrel 102.

As shown in FIG. 7A, two or more piston rods 112 (three are shown in the illustrated example) are provided to be connected with the hooks 129 of the piston 109. On the head of each piston rod 112 there is a groove 131 that receives a respective one of the hooks 129 of the piston 109. Under the tension of the main spring 113, the connection of the piston 109 and the two or more piston rods 112 is secured by the piston locking ring 110. The main spring 113 is wrapped around the two or more piston rods 112 and is separate from the barrel 102, and hence is less affected by the heat from sustained firing of the firearm. The main spring 113 also serves as a centrifugal restrain for the two or more piston rods 112 to limit the deformation caused by the compression force during the recoil sequence. For heavy barrel configuration, the two or more piston rods 112 can be designed to be in contact with the barrel 102 so that the barrel 102 can serve as the centripetal restrain for the piston rod 112. At the end of each piston rod 112, the design may include a hook 132 or hole 133 to connect with the bolt carrier (not shown). In some embodiments, the hook 132 or hole 133 may be simply welded to the bolt carrier. As shown in FIG. 7A, a relief cut 134 may be defined on one or some or all of the piston rods 112 to clear magazine or belt feed ammunition, depending on what kind of ammunition feeding method is used and the location where such device is applied.

As shown in FIG. 7B, the heat shield 111 may be a thin-wall sheet metal tube, with multiple ventilation holes 135 propagated along at least a portion of the length of the heat shield 111, e.g., in the rear section. When assembled, the front end of the heat shield 111 may be in contact with gas block 107 and the rear end of the heat shield 111 may be in contact with the barrel locking device 104, as shown in FIG. 1. When the piston 109 and the piston locking ring 110 are pushed backward towards the rear end of the barrel by force of the gas and returned by tension of the main spring 113, they in turn push the hot air around the barrel 102 away from the barrel 102 and induce fresh air to flow to the surrounding of the barrel 102 to help cool the barrel 102. The heat shield 111 helps promote such air cooling effect. When the piston 109 is pushed backward, hot air around the barrel 102 will be pushed out of the heat shield 111 though the ventilation holes 135. At the same time, fresh air will be induced into a barrel-heat shield vacuum created by the moving piston 109 through the venting holes 130. When the piston 109 stops and reciprocates back under the tension of the main spring 113, the above-described cooling cycle reverses. Fresh air will be induced into the barrel-heat shield vacuum through ventilation holes 135 and hot air will be pushed out through the venting holes 130 and gas vent holes 128. The heat shield 111 also functions to shield heat radiated from the barrel 102 to minimize the radiated heat felt by the firearm operator.

Example Embodiments for Regular Rifles

According to another implementation of the present disclosure, an annular piston system for a firearm may comprise a barrel, a gas block assembly, a piston, and a spring. The barrel may have a plurality of sections lengthwise. A first section of the barrel may have a first outer diameter. A second section of the barrel is adjacent the first section and may have a second outer diameter. A third section of the barrel is adjacent the second section and may have a third outer diameter. A distal end of the first section may be a first distal end of the barrel, and a distal end of the third section may be a second distal end of the barrel that is opposite the first distal end of the barrel. The second section may have at least one gas port hole traversing through a wall thickness thereof. The gas block assembly may be disposed annularly around the first and second sections of the barrel, and may be adjusted by an operator to control an amount of gas flowing out of the barrel through the at least one gas port hole. The piston may be disposed annularly around the third section of the barrel, and may move longitudinally along the barrel in response to being pushed by the gas flowing out of the barrel. The spring may be disposed annularly around the third section of the barrel and coupled to the piston. The spring may limit a distance that the piston moves longitudinally along the barrel when the piston is pushed to move towards the second distal end of the barrel by the gas flowing out of the barrel.

In some embodiments, the third outer diameter may be greater than the second outer diameter, and the second outer diameter may be greater than the first outer diameter.

In some embodiments, an outer surface of the third section of the barrel may have at least one straight flute thereon. Alternatively, the outer surface of the third section of the barrel may have at least one helical flute thereon.

In some embodiments, the first distal end of the barrel may include a threaded portion and the second distal end of the barrel may include a threaded portion. In some embodiments, the annular piston system may further comprise a muzzle device and a barrel extension. The muzzle device may mate with the threaded portion on the first distal end of the barrel. The barrel extension may mate with the threaded portion on the second distal end of the barrel. In some embodiments, the annular piston system may further comprise two or more piston rods, a piston locking ring, and a barrel locking device. The piston rods may be coupled to the piston and disposed between the spring and the barrel. The piston locking ring may be disposed annularly around the barrel and the piston rods and coupled to the piston. The barrel locking device may be disposed annularly around the barrel extension. A first end of the spring may be coupled to the piston locking ring and a second end of the spring opposite the first end may be coupled to the barrel locking device.

In some embodiments, the spring may provide centrifugal limit for the two or more piston rods.

In some embodiments, the two or more piston rods may be evenly distributed around the barrel. At least one of the piston rods may include a relief cut defined thereon to clear magazine or belt feed ammunition.

In some embodiments, a portion of an outer surface of the first section of the barrel may include a plurality of serrated protrusions. The gas block assembly may comprise a gas block, a gas block locking ring, and a locking spring. The gas block may be disposed annularly around the first section of the barrel and movable circumferentially with respect to the barrel. The gas block may have a plurality of inner diameter protrusions on an inner diameter thereof, and may be held in place with respect to the barrel when the inner diameter protrusions are engaged with the serrated protrusions of the first section of the barrel. The gas block locking ring may be disposed annularly around the first section of the barrel and between the barrel and the gas block. The gas block locking ring may be coupled to the gas block. The locking spring may be disposed annularly around the first section of the barrel and between the barrel and the gas block. The locking spring may be compressibly coupled between the gas block locking ring and the second section of the barrel such that the gas block is rotatable circumferentially with respect to the barrel when the inner diameter protrusions of the gas block are disengaged from the serrated protrusions of the first section of the barrel by the gas block being moved longitudinally towards the second distal end of the barrel with the locking spring compressed.

In some embodiments, the gas block may have a first hole and a second hole traversing through a wall thickness thereof. The first hole may have a size approximately equal to that of the at least one gas port hole. The second hole may have a size smaller than that of the at least one gas port hole. The gas block may be rotatable circumferentially with respect to the barrel between a first position to align the first hole with the at least one gas port hole to vent more gas from the barrel and a second position to align the second hole with the at least one gas port hole to vent less gas from the barrel.

Figure 8:
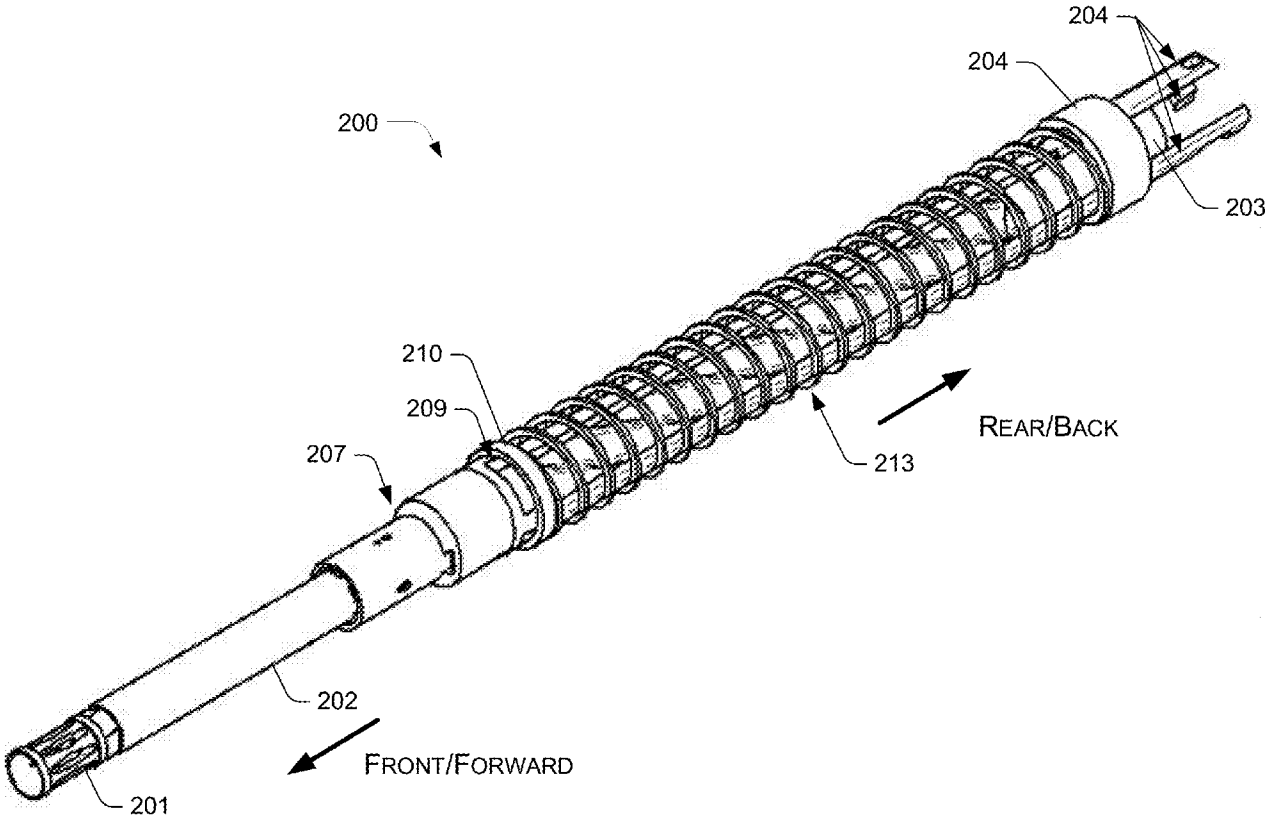
FIG. 8 is an assembly view of an annular piston system for regular rifles in accordance with a second embodiment of the present disclosure.
Figure 9:
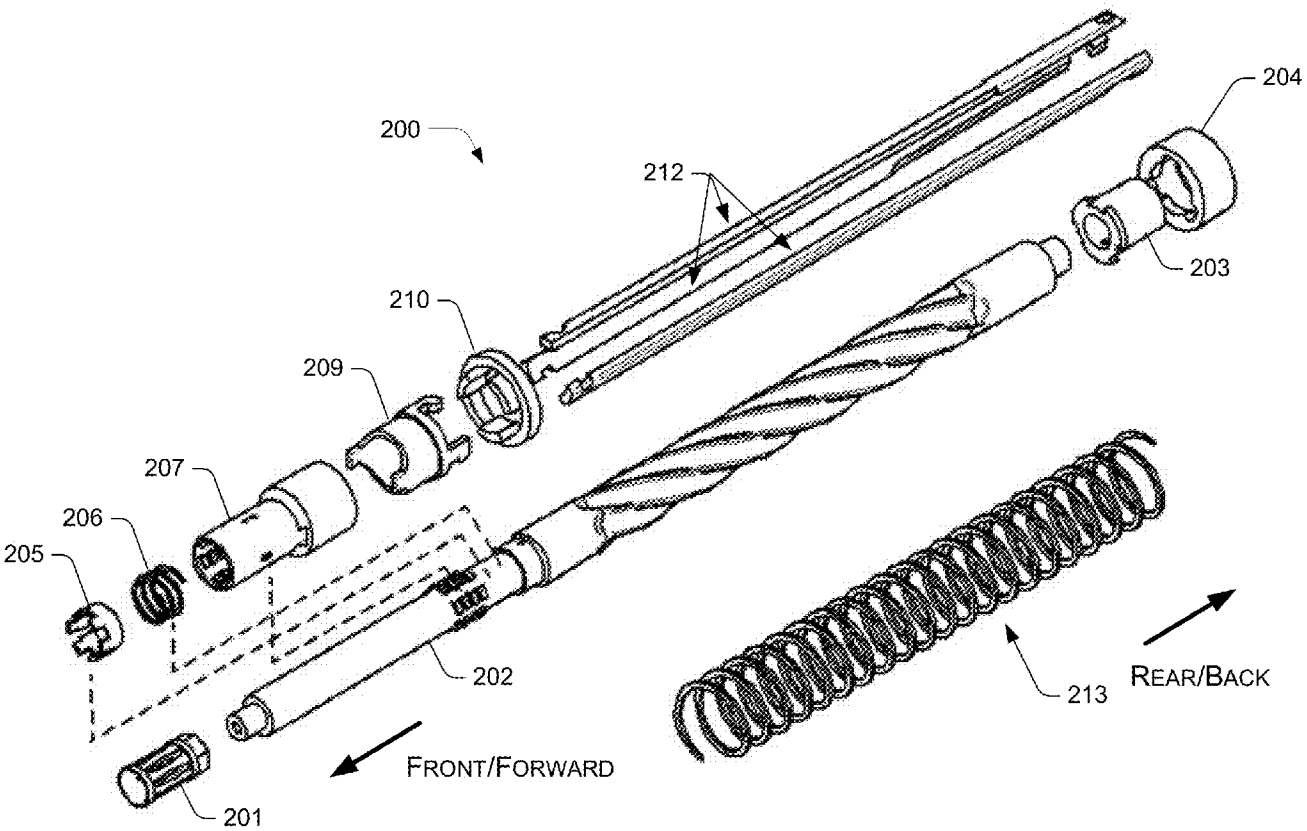
FIG. 9 is an exploded view of the annular piston system of FIG. 8.
Figure 10:
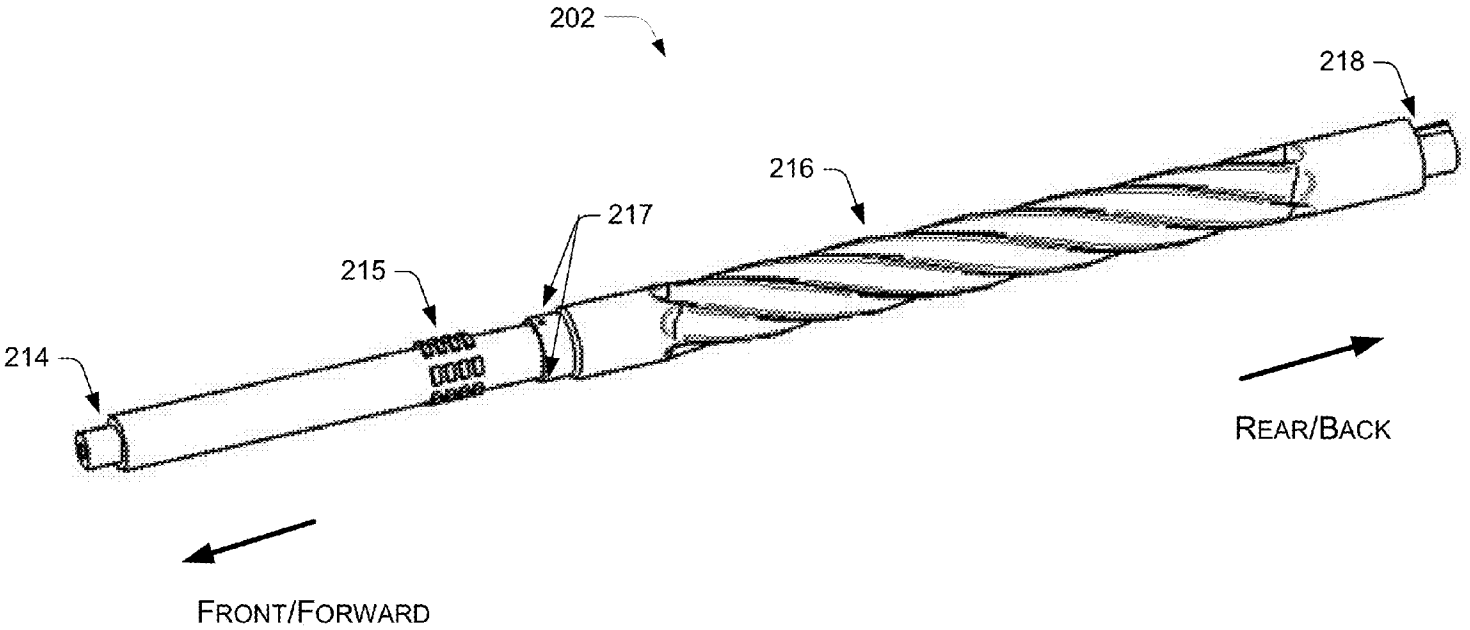
FIG. 10 is a perspective view of the barrel of the annular piston system of FIG. 8.

FIG. 8 illustrates an assembly view of a gas-operation annular piston system 200 for regular rifles. FIG. 9 illustrates an exploded view of the annular piston system 200. FIG. 10 illustrates a barrel 202 of the annular piston system 200.

As shown in FIG. 9, the annular piston system 200 comprises a muzzle device 201, a special profiled rifle barrel 202, a barrel extension 203, a barrel locking device 204, a gas block locking ring 205, a locking spring 206, a gas block 207, a piston 209, a piston locking ring 210, multiple piston rods 212 and a main spring 213. The annular piston system 200 is similar to the annular piston system 100 although the gas block assembly design is different. The gas block assembly includes the gas block 207, gas block locking ring 205, and locking spring 206 with the gas block 207 serving a dual function as the gas regulator. This design may be used in the annular piston system 100, and vice versa. As the annular piston system 200 does not include a heat shield, the external geometry of the gas block 207 is changed accordingly.

As shown in FIG. 10, the barrel 202 has a generally step-down profile in an axial direction from the rear end towards the front end. That is, the barrel 202 can be seen as having multiple sections—the section near the rear end having the largest diameter and each successive section toward the front having a smaller diameter with the section at the front end having the smallest diameter. Such feature allows the ease of disassembling the annular piston system 200. On the front half of the barrel 202, step 214 is threaded and is where the muzzle device 201 is received when assembled. The serrated steps 215 are used to hold the gas block 207 in the longitudinal direction. The gas block 207 has matching internal steps to mate with the steps 215 on the barrel 202. After that, the barrel 202 has a raised feature referred to herein as the gas port 217 step. Here, two holes 217 may be drilled through the wall of the barrel 202, positioned slightly distanced from each other, to introduce hot gas into the gas block 207 when assembled. The holes 217 may be drilled either vertically with respect to the wall of the barrel 202 or with an angle with respect to the axis of the barrel 202. Here, the gas block 207 serves the dual function as a gas regulator with functions similar to those of the gas regulator 108 of the annular piston system 100. After the gas port 217 step, the diameter of the barrel 202 remains unchanged until the barrel extension thread step 218. Some grooves or flutes 216, either helical shown or straight, may be cut into the barrel 202 to lower the barrel weight. The barrel extension 103 is mated with the barrel 102 at the barrel extension thread step 218. The barrel locking device 204 may be a barrel nut (as shown in FIG. 9) or some quick change barrel locking device commonly used in machine gun barrel design.

Figure 11B:
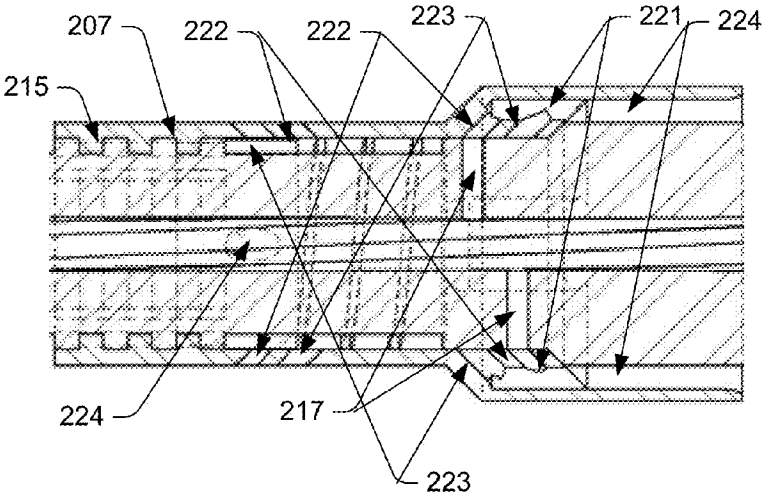
FIG. 11B is a diagram showing a gas block regulator function in accordance with an embodiment of the present disclosure.
Figure 11A:
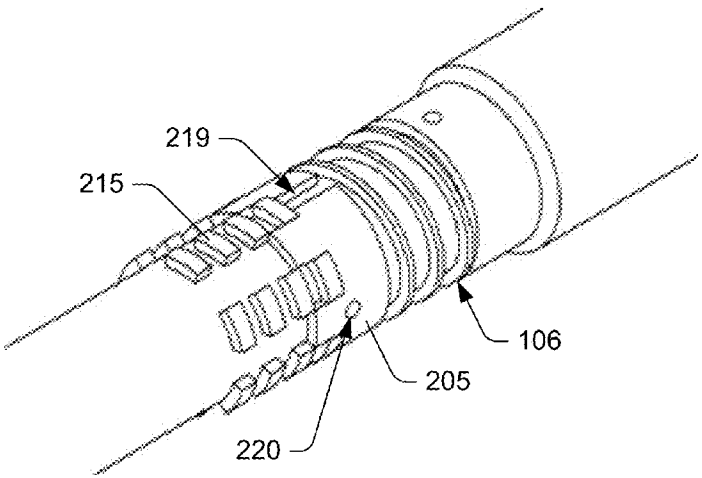
FIG. 11A is a gas block locking mechanism in accordance with an embodiment of the present disclosure.

FIG. 11A illustrates a gas block locking mechanism. FIG. 11B illustrates the gas block regulator function.

As shown in FIG. 11A, the gas block locking ring 205 has a cut 219 on the side of its wall along the longitudinal direction. The gas block locking ring 205 has an inner diameter that is slightly larger than the outer diameter of the barrel 202 where they are mounted, while the outer diameter of the gas block locking ring 205 is slightly smaller than the inner diameter of the gas block 207 where they are located when mounted. To mount gas block locking ring 205 through the front end of the barrel 202, the gas block locking ring 205 needs to be sprung open from its cuts on the wall to clear the bigger diameter of the steps 215 on the barrel 202. The locking spring 206 can be rotated through the steps 215 to be assembled in position. To assemble, the gas block 207 is pushed into the position with the right index relationship with the step 215. The gas block locking ring 205 will be pushed back with the gas block 207. When the teeth on the gas block 207 are clear of the corresponding steps 215, the gas block 207 can be turned. Under the tension of the locking spring 206, the gas block locking ring 205 will lock the gas block 207 once the teeth on the gas block 207 have been turned out of the way. To disassemble, two bullet heads can be used to push the gas block locking ring 205 backward through two push holes 220 (one on each side) on the wall. The gas block 207 has corresponding clearance hole 224 (shown in FIG. 11B) on its wall as well. When the gas block locking ring 205 is pushed back to clear out of the way, the gas block 207 can be turn and then pulled out of its locking position.

FIG. 11B shows how the gas block 207 functions as a gas regulator, similar to the gas regulator 108 in the annular piston system 100. Compared to the gas block 107, two horizontal blind holes 221 are drilled into the wall of the gas block 207. On the same plane of the two holes 221, two sets of gas holes 222 and 223 are drilled through the wall of the gas block 207 in an angle and through with the holes 221. The gas holes 222 have a smaller diameter than the diameter of the gas holes 223, while the gas holes 223 have the same diameter as that of the gas port 217. There are four gas holes 222 and gas holes 223 on the top and the bottom. Two of each, either gas holes 222 or gas holes 223 but not both, are aligned with the gas port 217. The other two gas holes 222 and two gas holes 223 are drill-through holes on the gas block wall due to manufacturing needs. As shown in FIG. 11B, the two gas ports 217 are positioned apart by a distance corresponding to the distance between gas holes 222 and gas holes 223. When the gas block 207 is assemble in a first position, as shown in FIG. 11B, each gas hole 222 is aligned with the corresponding gas port 217. When more gas is needed, the gas block 207 can be turned 180 degree to a second position (not shown) so that each gas hole 223 will be aligned with each corresponding gas ports 217, hence rendering the gas block 207 to also serve as a gas regulator in addition to being a gas block.

The piston 209, piston rod 212 and piston locking ring 210 may be identical to those of the annular piston system 100 respectively.

Example Embodiments for Lightweight Rifles

According to a further implementation of the present disclosure, an annular piston system for a firearm may comprise a barrel, a gas block, a piston, and a spring. The barrel may have a plurality of sections lengthwise. A first section of the barrel may have a first outer diameter. A second section of the barrel is adjacent the first section and may have a second outer diameter. A third section of the barrel is adjacent the second section and may have a third outer diameter. A fourth section of the barrel is adjacent the third section and may have a fourth outer diameter. A distal end of the first section may be a first distal end of the barrel. A distal end of the fourth section may be a second distal end of the barrel that is opposite the first distal end of the barrel. The second section may have at least one gas port hole traversing through a wall thickness thereof. The gas block may be disposed annularly around the first and second sections of the barrel. The gas block may be adjusted by an operator to control an amount of gas flowing out of the barrel through the at least one gas port hole. The piston may be disposed annularly around the third section of the barrel, and can move longitudinally along the barrel in response to being pushed by the gas flowing out of the barrel. The spring may be disposed annularly around the third and fourth sections of the barrel and coupled to the piston. The spring may limit a distance that the piston moves longitudinally along the barrel when the piston is pushed to move towards the second distal end of the barrel by the gas flowing out of the barrel.

In some embodiments, the fourth outer diameter may be greater than the third outer diameter. The third outer diameter may be greater than the second outer diameter. The second outer diameter may be greater than the first outer diameter.

In some embodiments, an outer surface of the third section of the barrel may have at least one straight flute thereon. Alternatively, the outer surface of the third section of the barrel may have at least one helical flute thereon.

In some embodiments, a first distal end of the gas block toward the first distal end of the barrel may be configured to function as a muzzle. The second distal end of the barrel may include a threaded portion. In some embodiments, the annular piston system may further comprise a barrel extension that mates with the threaded portion on the second distal end of the barrel. Additionally, the annular piston system may also comprise two or more piston rods, a piston locking ring, and a barrel locking device. The piston rods may be coupled to the piston and disposed between the spring and the barrel. The piston locking ring may be disposed annularly around the barrel and the piston rods and coupled to the piston. The barrel locking device may be disposed annularly around the barrel extension. A first end of the spring may be coupled to the piston locking ring. A second end of the spring opposite the first end may be coupled to the barrel locking device.

In some embodiments, the spring may provide centrifugal limit for the two or more piston rods.

In some embodiments, the two or more piston rods may be evenly distributed around the barrel. At least one of the piston rods may include a relief cut defined thereon to clear magazine or belt feed ammunition.

In some embodiments, a portion of an outer surface of the first section of the barrel may include a plurality of serrated protrusions. An inner diameter of the gas block may include a plurality of inner diameter protrusions such that the gas block is held in place with respect to the barrel when the inner diameter protrusions are engaged with the serrated protrusions of the first section of the barrel. In some embodiments, the annular piston system may further comprise a gas block locking ring and a locking spring. The gas block locking ring may be disposed annularly around the first section of the barrel and between the barrel and the gas block, and may be coupled to the gas block. The locking spring may be disposed annularly around the first section of the barrel and between the barrel and the gas block. The locking spring may be compressibly coupled between the gas block locking ring and the second section of the barrel such that the gas block is rotatable circumferentially with respect to the barrel when the inner diameter protrusions of the gas block are disengaged from the serrated protrusions of the first section of the barrel by the gas block being moved longitudinally towards the second distal end of the barrel with the locking spring compressed. In some embodiments, the gas block may have a first hole and a second hole traversing through a wall thickness thereof. The first hole may have a size approximately equal to that of the at least one gas port hole. The second hole may have a size smaller than that of the at least one gas port hole. The gas block may be rotatable circumferentially with respect to the barrel between a first position to align the first hole with the at least one gas port hole to vent more gas from the barrel and a second position to align the second hole with the at least one gas port hole to vent less gas from the barrel.

Figure 12:
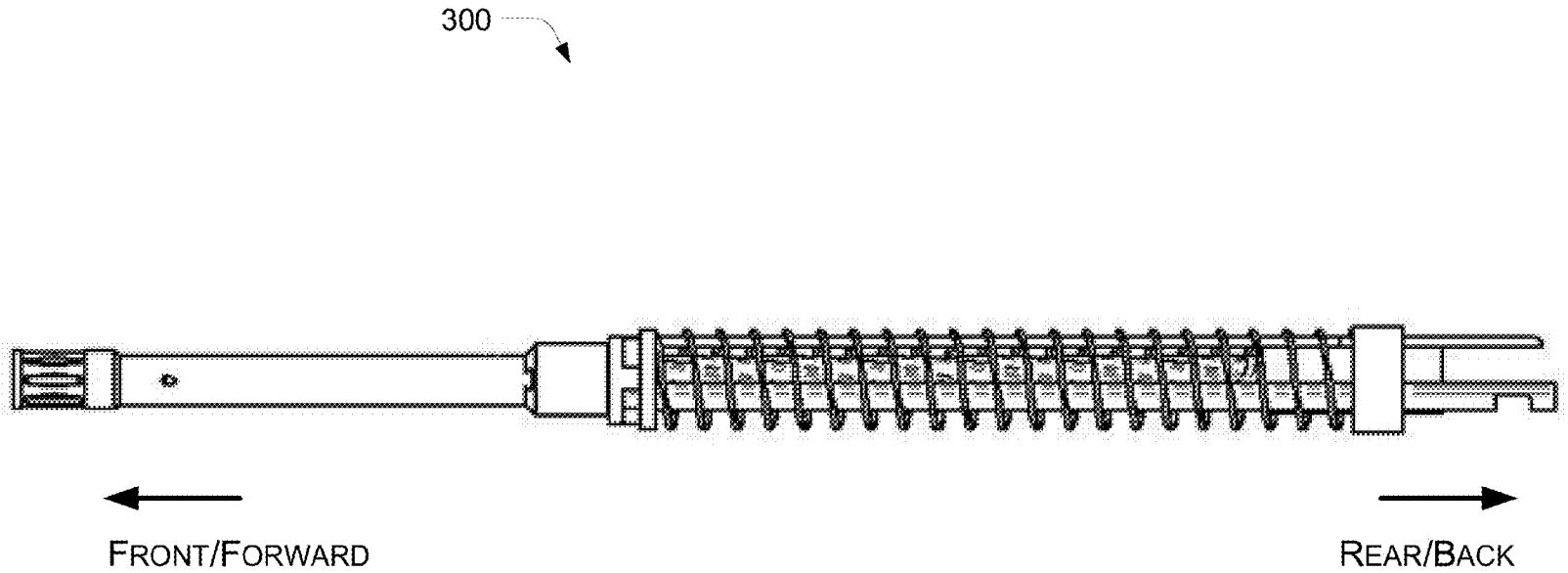
FIG. 12 is an assembly view of an annular piston system in accordance with a third embodiment of the present disclosure.
Figure 13:
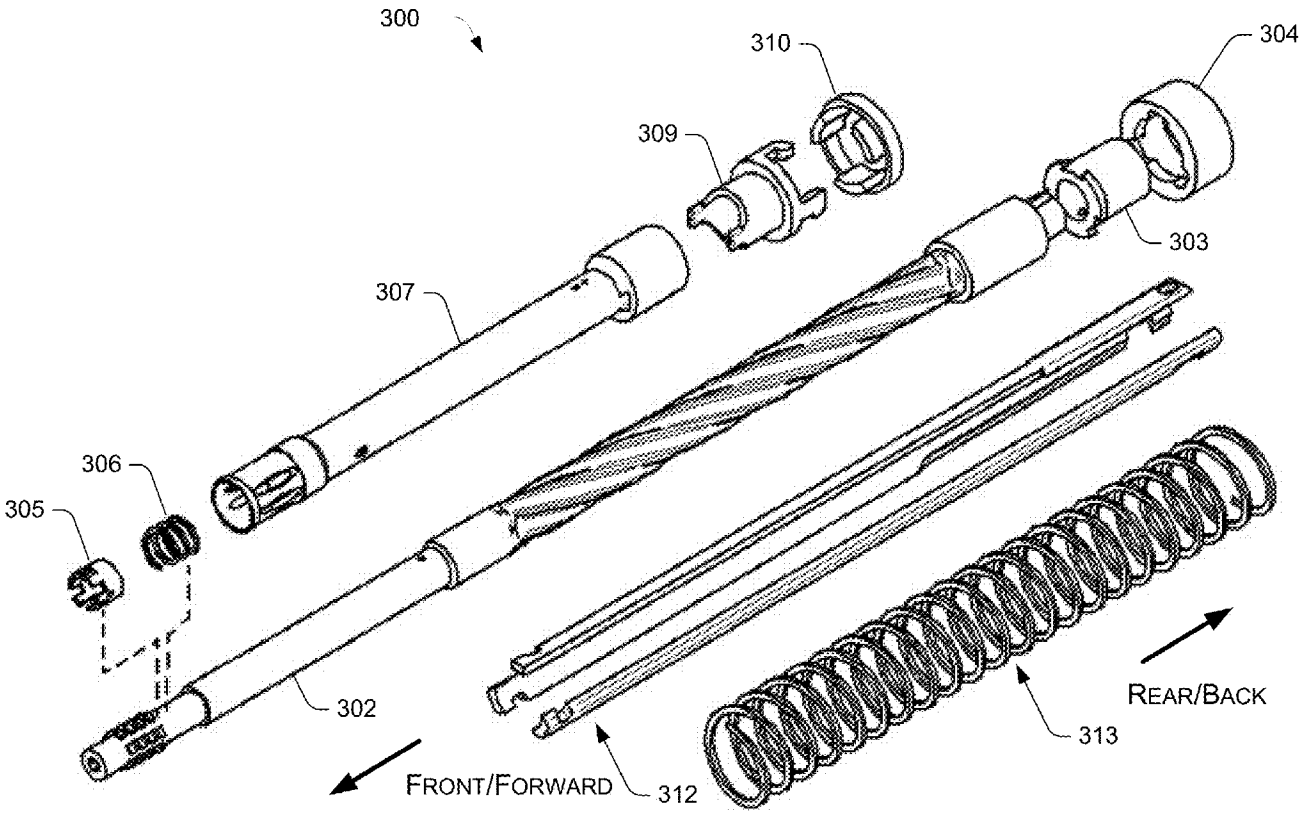
FIG. 13 is an exploded view of the annular piston system of FIG. 12.
Figure 14:
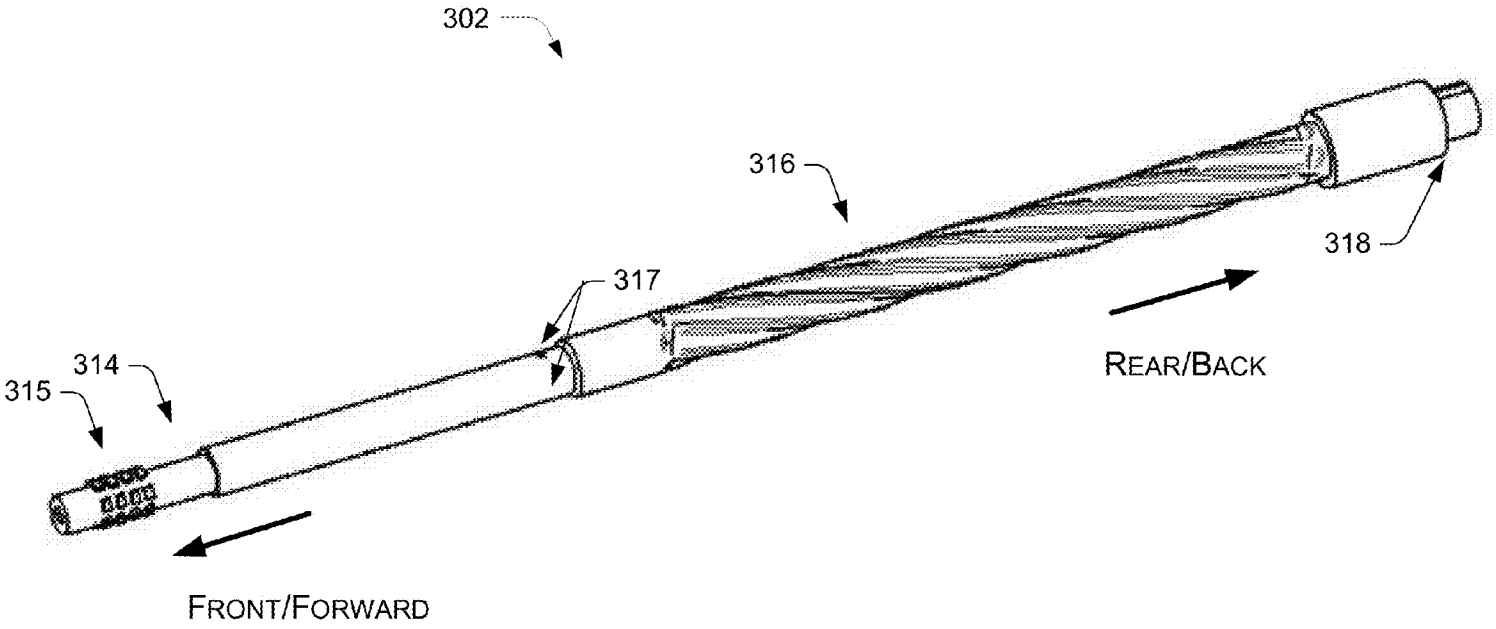
FIG. 14 is a perspective view of a lightweight barrel of the annular piston system of FIG. 12.
Figure 15:
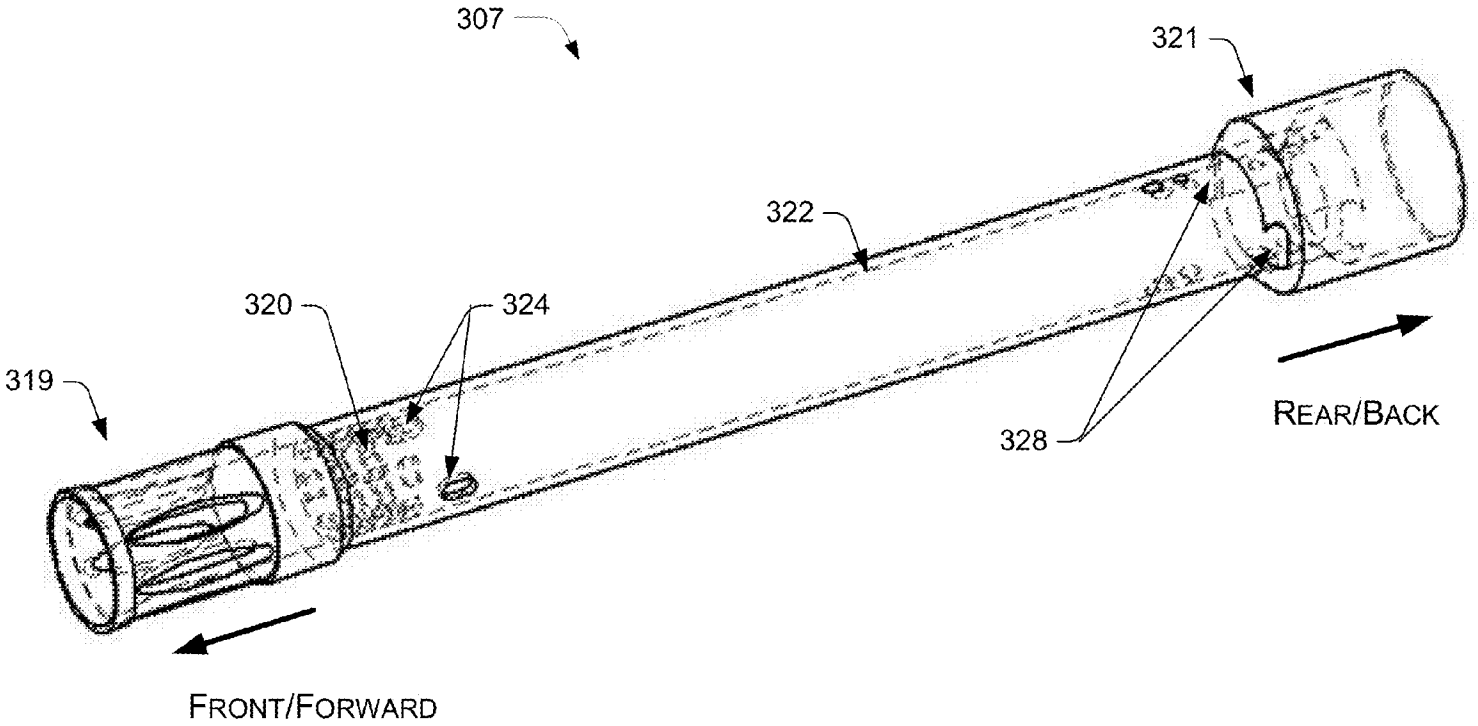
FIG. 15 is a perspective view of a gas block for the lightweight barrel of FIG. 12.

For some special purpose rifle, a lightweight barrel is preferred. The gas-operation annular piston system 300, shown in FIG. 12, is designed to suit such need. FIG. 12 illustrates an assembly view of the annular piston system 300. FIG. 13 illustrates an exploded view of the annular piston system 300. FIG. 14 illustrates a lightweight barrel 302 of the annular piston system 300. FIG. 15 illustrates a gas block 307 of the lightweight barrel 302.

As shown in FIG. 13, the annular piston system 300 comprises a lightweight barrel 302, a barrel extension 303, a barrel locking device 304, a gas block locking ring 305, a locking spring 306, a gas block 307, a piston 309, a piston locking ring 310, multiple piston rods 312, and a main spring 313. The annular piston system 300 is similar to the annular piston system 200. However, the gas block 307 has the combined functions of the gas block 207 and the muzzle device 201. The barrel 302, gas block locking ring 305, locking spring 306, piston 309 and piston locking ring 310 may be similar to their correspondent parts in the annular piston system 200, but with different dimensions. The barrel extension 303, barrel locking device 304, piston rods 312 and main spring 313 may be identical to those in the configuration 200.

As shown in FIG. 14, the light weight barrel 302 has a diameter that is similar to but smaller than that of the barrel 202 of the annular piston system 200. In particular, the barrel 302 has a plurality of flute cuts 316 and a smaller overall diameter compare to barrel 202 of the annular piston system 200. The serrated steps 315 are located on the step 314. The step 318 may be the same as the step 218, and allows the use of the same barrel extension 303.

As shown in FIG. 15, a rear part 321 of the gas block 307 may be identical to that of the gas block 207, except that the diameter of the rear part 321 may be smaller. A front part 319 of the gas block 307 is designed to function as a muzzle device. The front part 319 and the rear part 321 are joined by a long shank 322. Mounting steps 320 and clearance holes 324 are closer to the muzzle device of the barrel 302. This design also allows the gas block 307 to function as a gas regulator with the same functionality design as that of the annular piston system 200.

Conclusion

It will be apparent to those skilled in the art that various modifications and variations can be made to the structure of the present disclosure without departing from the scope or spirit of the present disclosure. In view of the foregoing, it is intended that the present disclosure cover modifications and variations of the present disclosure provided they fall within the scope of the following claims and their equivalents.

What is claimed is:

1. An annular piston system for a firearm, the annular piston system comprising:

a barrel having a plurality of sections lengthwise, a first section of the barrel having a first outer diameter, a second section of the barrel adjacent the first section and having a second outer diameter, a third section of the barrel adjacent the second section and having a third outer diameter, a distal end of the first section being a first distal end of the barrel, a distal end of the third section being a second distal end of the barrel opposite the first distal end of the barrel, the second section having at least one gas port hole traversing through a wall thickness thereof, wherein the first distal end of the barrel includes a threaded portion, and wherein the second distal end of the barrel includes a threaded portion;

a gas block assembly disposed annularly around the first and second sections of the barrel, the gas block assembly adjustably controlling an amount of gas flowing out of the barrel through the at least one gas port hole;

a piston disposed annularly around the third section of the barrel, the piston configured to move longitudinally along the barrel in response to being pushed by the gas flowing out of the barrel;

a spring disposed annularly around the third section of the barrel and coupled to the piston, the spring configured to limit a distance that the piston moves longitudinally along the barrel when the piston is pushed to move towards the second distal end of the barrel by the gas flowing out of the barrel;

a muzzle device that mates with the threaded portion on the first distal end of the barrel;

a barrel extension that mates with the threaded portion on the second distal end of the barrel;

two or more piston rods coupled to the piston and disposed between the spring and the barrel;

a piston locking ring disposed annularly around the barrel and the piston rods and coupled to the piston; and a barrel locking device disposed annularly around the barrel extension, wherein a first end of the spring is coupled to the piston locking ring and a second end of the spring opposite the first end is coupled to the barrel locking device.

2. The annular piston system of claim 1, wherein the third outer diameter is greater than the second outer diameter, and wherein the second outer diameter is greater than the first outer diameter.

3. The annular piston system of claim 1, wherein an outer surface of the third section of the barrel has at least one straight flute thereon.

4. The annular piston system of claim 1, wherein an outer surface of the third section of the barrel has at least one helical flute thereon.

5. The annular piston system of claim 1, wherein the spring provides centrifugal limit for the two or more piston rods.

6. The annular piston system of claim 1, wherein the two or more piston rods are evenly distributed around the barrel, and wherein at least one of the piston rods includes a relief cut defined thereon to clear magazine or belt feed ammunition.

7. The annular piston system of claim 1, further comprising:

a heat shield disposed annularly around the barrel and shrouding the gas block assembly, the piston, and the spring.

8. The annular piston system of claim 7, wherein at least a portion of a length of the heat shield includes a plurality of ventilation holes.

9. The annular piston system of claim 1, wherein the gas block assembly comprises:

a gas block disposed annularly around the first section of the barrel and movable circumferentially with respect to the barrel;

a gas block locking ring disposed annularly around the first section of the barrel and between the barrel and the gas block, the gas block locking ring coupled to the gas block; and a ring actuator disposed annularly around the first section of the barrel and between the barrel and the gas block, the ring actuator coupled to the gas block locking ring and movable circumferentially with respect to the barrel to rotate the gas block locking ring between a first position and a second position, wherein the gas block is locked with respect to the barrel when the gas block locking ring is in the first position, and wherein the gas block is unlocked with respect to the barrel when the gas block locking ring is in the second position.

10. The annular piston system of claim 9, wherein a portion of an outer surface of the first section of the barrel includes a plurality of serrated protrusions that hold the gas block in place longitudinally with respect to the barrel.

11. The annular piston system of claim 9, wherein the gas block assembly further comprises:

a gas regulator disposed annularly around the second section of the barrel, the gas regulator having a first hole and a second hole traversing through a wall thickness thereof, the first hole having a size approximately equal to that of the at least one gas port hole, the second hole having a size smaller than that of the at least one gas port hole, the gas regulator movable circumferentially with respect to the barrel between a first position to align the first hole with the at least one gas port hole to vent more gas from the barrel and a second position to align the second hole with the at least one gas port hole to vent less gas from the barrel.

12. The annular piston system of claim 1, wherein a portion of an outer surface of the first section of the barrel includes a plurality of serrated protrusions.

13. The annular piston system of claim 12, wherein the gas block assembly comprises:

a gas block disposed annularly around the first section of the barrel and movable circumferentially with respect to the barrel, the gas block having a plurality of inner diameter protrusions on an inner diameter thereof, the gas block held in place with respect to the barrel when the inner diameter protrusions are engaged with the serrated protrusions of the first section of the barrel;

a gas block locking ring disposed annularly around the first section of the barrel and between the barrel and the gas block, the gas block locking ring coupled to the gas block; and a locking spring disposed annularly around the first section of the barrel and between the barrel and the gas block, the locking spring compressibly coupled between the gas block locking ring and the second section of the barrel such that the gas block is rotatable circumferentially with respect to the barrel when the inner diameter protrusions of the gas block are disengaged from the serrated protrusions of the first section of the barrel by the gas block being moved longitudinally towards the second distal end of the barrel with the locking spring compressed.

14. The annular piston system of claim 13, wherein the gas block has a first hole and a second hole traversing through a wall thickness thereof, the first hole having a size approximately equal to that of the at least one gas port hole, the second hole having a size smaller than that of the at least one gas port hole, the gas block rotatable circumferentially with respect to the barrel between a first position to align the first hole with the at least one gas port hole to vent more gas from the barrel and a second position to align the second hole with the at least one gas port hole to vent less gas from the barrel.

15. An annular piston system for a firearm, the annular piston system comprising:

a barrel having a plurality of sections lengthwise, a first section of the barrel having a first outer diameter, a second section of the barrel adjacent the first section and having a second outer diameter, a third section of the barrel adjacent the second section and having a third outer diameter, a fourth section of the barrel adjacent the third section and having a fourth outer diameter, a distal end of the first section being a first distal end of the barrel, a distal end of the fourth section being a second distal end of the barrel opposite the first distal end of the barrel, the second section having at least one gas port hole traversing through a wall thickness thereof, wherein the second distal end of the barrel includes a threaded portion;

a gas block disposed annularly around the first and second sections of the barrel, the gas block adjustably controlling an amount of gas flowing out of the barrel through the at least one gas port hole;

a piston disposed annularly around the third section of the barrel, the piston configured to move longitudinally along the barrel in response to being pushed by the gas flowing out of the barrel;

a spring disposed annularly around the third and fourth sections of the barrel and coupled to the piston, the spring configured to limit a distance that the piston moves longitudinally along the barrel when the piston is pushed to move towards the second distal end of the barrel by the gas flowing out of the barrel;

a barrel extension that mates with the threaded portion on the second distal end of the barrel;

two or more piston rods coupled to the piston and disposed between the spring and the barrel;

a piston locking ring disposed annularly around the barrel and the piston rods and coupled to the piston; and a barrel locking device disposed annularly around the barrel extension, wherein a first end of the spring is coupled to the piston locking ring and a second end of the spring opposite the first end is coupled to the barrel locking device.

16. The annular piston system of claim 15, wherein the fourth outer diameter is greater than the third outer diameter, wherein the third outer diameter is greater than the second outer diameter, and wherein the second outer diameter is greater than the first outer diameter.

17. The annular piston system of claim 15, wherein an outer surface of the third section of the barrel has at least one straight flute thereon.

18. The annular piston system of claim 15, wherein an outer surface of the third section of the barrel has at least one helical flute thereon.

19. The annular piston system of claim 15, wherein a first distal end of the gas block toward the first distal end of the barrel is configured to function as a muzzle device.

20. The annular piston system of claim 15, wherein the spring provides centrifugal limit for the two or more piston rods.

21. The annular piston system of claim 15, wherein the two or more piston rods are evenly distributed around the barrel, and wherein at least one of the piston rods includes a relief cut defined thereon to clear magazine or belt feed ammunition.

22. The annular piston system of claim 15, wherein a portion of an outer surface of the first section of the barrel includes a plurality of serrated protrusions, and wherein an inner diameter of the gas block includes a plurality of inner diameter protrusions such that the gas block is held in place with respect to the barrel when the inner diameter protrusions are engaged with the serrated protrusions of the first section of the barrel.

23. The annular piston system of claim 22, further comprising:

a gas block locking ring disposed annularly around the first section of the barrel and between the barrel and the gas block, the gas block locking ring coupled to the gas block; and a locking spring disposed annularly around the first section of the barrel and between the barrel and the gas block, the locking spring compressibly coupled between the gas block locking ring and the second section of the barrel such that the gas block is rotatable circumferentially with respect to the barrel when the inner diameter protrusions of the gas block are disengaged from the serrated protrusions of the first section of the barrel by the gas block being moved longitudinally towards the second distal end of the barrel with the locking spring compressed.

24. The annular piston system of claim 23, wherein the gas block has a first hole and a second hole traversing through a wall thickness thereof, the first hole having a size approximately equal to that of the at least one gas port hole, the second hole having a size smaller than that of the at least one gas port hole, the gas block rotatable circumferentially with respect to the barrel between a first position to align the first hole with the at least one gas port hole to vent more gas from the barrel and a second position to align the second hole with the at least one gas port hole to vent less gas from the barrel.

* * * * *